US007431411B2

(12) United States Patent
Brenner

(10) Patent No.: US 7,431,411 B2
(45) Date of Patent: Oct. 7, 2008

(54) REFILLING A PRINT CARTRIDGE RESERVOIR

(75) Inventor: James M. Brenner, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 520 days.

(21) Appl. No.: 10/665,183

(22) Filed: Sep. 17, 2003

(65) Prior Publication Data

US 2005/0057586 A1 Mar. 17, 2005

(51) Int. Cl.
*B41J 2/195* (2006.01)
*B41J 2/175* (2006.01)

(52) U.S. Cl. ..... 347/7; 347/85

(58) Field of Classification Search ..... 347/7
See application file for complete search history.

(56) References Cited

U.S. PATENT DOCUMENTS

| | | | | |
|---|---|---|---|---|
| 4,187,511 | A | | 2/1980 | Robinson |
| 4,342,042 | A | | 7/1982 | Cruz-Uribe et al. |
| 4,462,037 | A | | 7/1984 | Bangs et al. |
| 4,973,993 | A | | 11/1990 | Allen |
| 5,296,268 | A | | 3/1994 | Iantosca |
| 5,367,328 | A | | 11/1994 | Erickson |
| 5,561,453 | A | * | 10/1996 | Shibata et al. ..... 347/85 |
| 5,629,727 | A | | 5/1997 | Erickson |
| 5,710,579 | A | * | 1/1998 | Hahs et al. ..... 347/7 |
| 5,751,321 | A | | 5/1998 | Erickson |
| 5,788,388 | A | * | 8/1998 | Cowger et al. ..... 400/703 |
| 5,801,835 | A | | 9/1998 | Mizutani et al. |
| 5,887,793 | A | | 3/1999 | Erickson |
| 5,917,908 | A | | 6/1999 | Takenaka et al. |
| 6,164,766 | A | | 12/2000 | Erickson |
| 6,227,659 | B1 | | 5/2001 | Lopez et al. |
| 6,364,545 | B1 | * | 4/2002 | Horn et al. ..... 396/578 |
| 6,467,887 | B2 | | 10/2002 | Lopez et al. |
| 6,796,627 | B2 | * | 9/2004 | Kimura et al. ..... 347/7 |
| 6,874,861 | B2 | * | 4/2005 | Farr et al. ..... 347/19 |
| 2003/0007040 | A1 | | 1/2003 | Love et al. |

FOREIGN PATENT DOCUMENTS

JP 2002029041 A * 1/2002

* cited by examiner

*Primary Examiner*—Matthew Luu
*Assistant Examiner*—Shelby Fidler

(57) ABSTRACT

Methods, devices, and programs are provided for refilling a print cartridge reservoir. A method includes tracking an ink volume in the print cartridge reservoir. The method includes tracking an ink volume in a supply tank. The method further includes refilling the print cartridge reservoir from the supply tank when the ink volume in the supply tank substantially equals an ink volume to refill the print cartridge reservoir to a predetermined level.

10 Claims, 6 Drawing Sheets

REFILLING A PRINT CARTRIDGE RESERVOIR

Printing devices incorporating printheads rely on ink supplies to generate printed images. These printheads can be integrated in a print cartridge containing an ink reservoir. Ink consumed by the printhead to generate a printed image is drawn from the print cartridge ink reservoir.

To address issues associated with the frequency of print cartridge replacement and refilling, larger supply tank reservoirs have been added to some printing devices. These larger supply tanks may be used with fixed period print cartridge refill systems. That is, ink is periodically transferred to the print cartridge reservoir when the print cartridge reservoir is depleted. Fixed period ink transfer systems, e.g., refilling triggered when the print cartridge reservoir is empty, can produce scenarios where the volume remaining in the supply tank is insufficient to fully refill the print cartridge reservoir. This can create an impression to the user that the supply tank delivers inconsistent refills.

DETAILED DESCRIPTION

Refilling print cartridge reservoirs from a supply tank based on tracked ink volumes, according to embodiments described below, can aid in the predictability of refill volumes without using continuous supply positive pressure. For example, by refilling the print cartridge reservoir when the ink volume remaining in the supply tank is equal to the ink volume used to refill the print cartridge reservoir to a predetermined level, the print cartridge reservoir will be refilled when the supply tank is depleted. This method consistently produces print cartridge reservoirs refilled to the predetermined level between supply tank replacements.

In contrast, refilling print cartridge reservoirs when empty without tracking supply tank volumes could deplete the supply tank before a print cartridge reservoir is refilled to the predetermined level. This method can lead to print cartridge reservoirs that are refilled to less than a predetermined level. Such refilled print cartridge reservoirs may create an inconsistency in the number of pages that can be printed between supply tank replacements.

Embodiments of the invention provide various techniques for refilling print cartridge reservoirs, and include programs and devices for performing the same. Various embodiments provide the ability to track ink volumes in both the print cartridge reservoir and the supply tank, and to transfer ink from the supply tank to the print cartridge reservoir based on a variable refill frequency. In various embodiments the refill frequency is established such that refilling occurs when the print cartridge reservoir is empty, or near empty, or the volume of ink available in the supply tank is equal to a volume of ink used to refill the print cartridge reservoir to the predetermined level.

Figure 1:
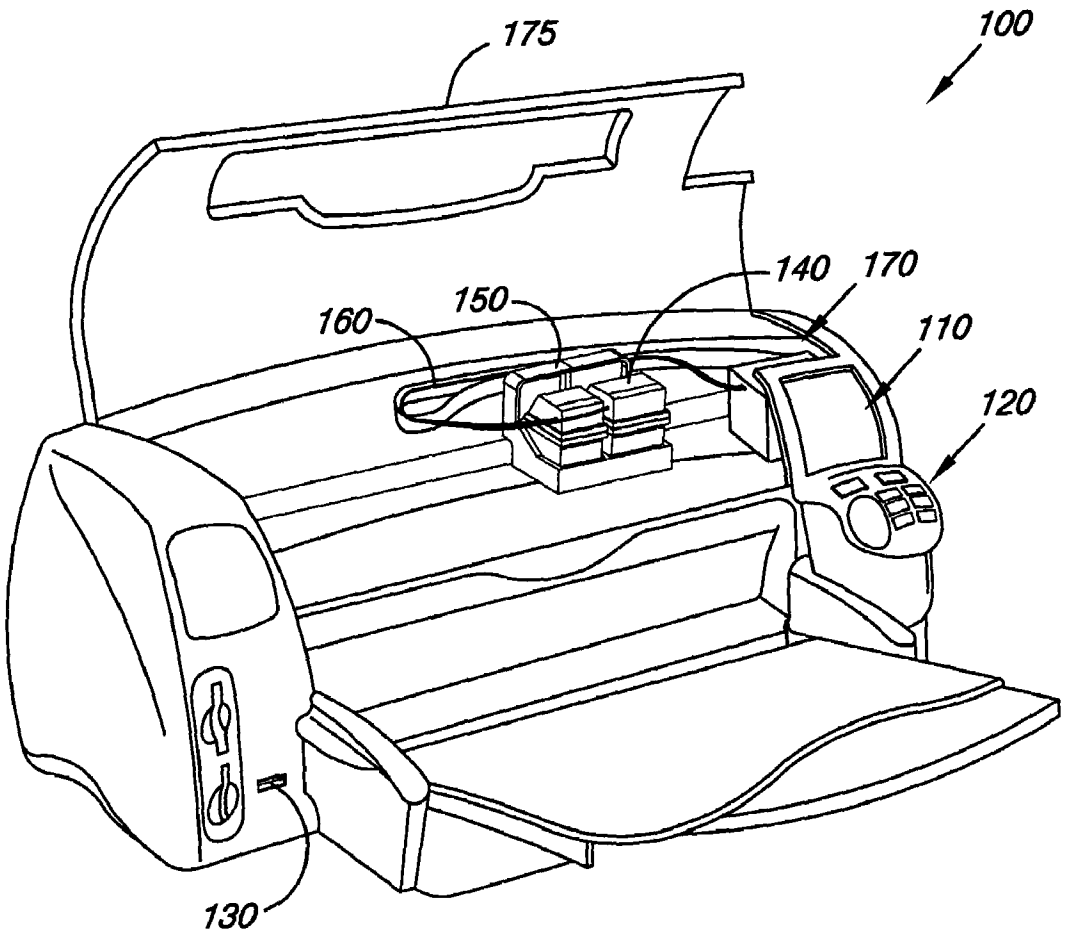
FIG. 1 illustrates an embodiment of a image forming device.

FIG. 1 provides a perspective illustration of an embodiment of an image forming device 100, such as a printing device, which is operable to implement, or which can include, embodiments of the invention. The embodiment of FIG. 1 illustrates an inkjet printing device 100 which can be used in an office or home environment. However, embodiments of the invention can include other types of image forming devices.

As illustrated in FIG. 1, an embodiment of the printing device 100 can include a display 110. In addition, an embodiment of the printing device 100 can include a keypad 120 for data entry and an I/O port 130 for receiving data from other devices. By way of example and not by way of limitation, the I/O port 130 can include a slot for a flash card and can include a Universal Serial Bus (USB) port operable to download USB data. The printing device 100 can operate as a stand alone device and/or can be used as a printing device in a networked system, such as the printing device 810 shown in the network system 800 of FIG. 8.

The printing device 100 includes a print cartridge 140 mounted in a movable print carriage 150. The print cartridge 140 contains both an ink reservoir and a printhead, shown in FIG. 3, for ejecting ink onto print job media. The movable print carriage 150 can scan the print cartridge 140 across the print media while performing a print job. The embodiment of FIG. 1 illustrates a flexible conduit 160, such as a flexible tube, which can connect the print cartridge reservoir to a replaceable supply tank reservoir via a pump. In the embodiment of FIG. 1, the pump and supply tank reservoir (shown in FIG. 3) are located off-axis, e.g., they are not located on the movable print carriage 150. The pump and supply tank reservoir can be located in a service bay area, shown generally at 170, inside the housing and accessible by a user when a cover 175 of the printing device is open as shown in FIG. 1. A service bay area includes a location in the printing device away from the media marking area. The print cartridge reservoir, the pump, and the supply tank are part of various embodiments of an ink transfer mechanism, or system, for variable frequency refilling of the print cartridge reservoir. In various embodiments one supply tank can be used to refill multiple print cartridge reservoirs and multiple supply tanks can be used to refill one print cartridge reservoir. Embodiments are not so limited.

Figure 2:
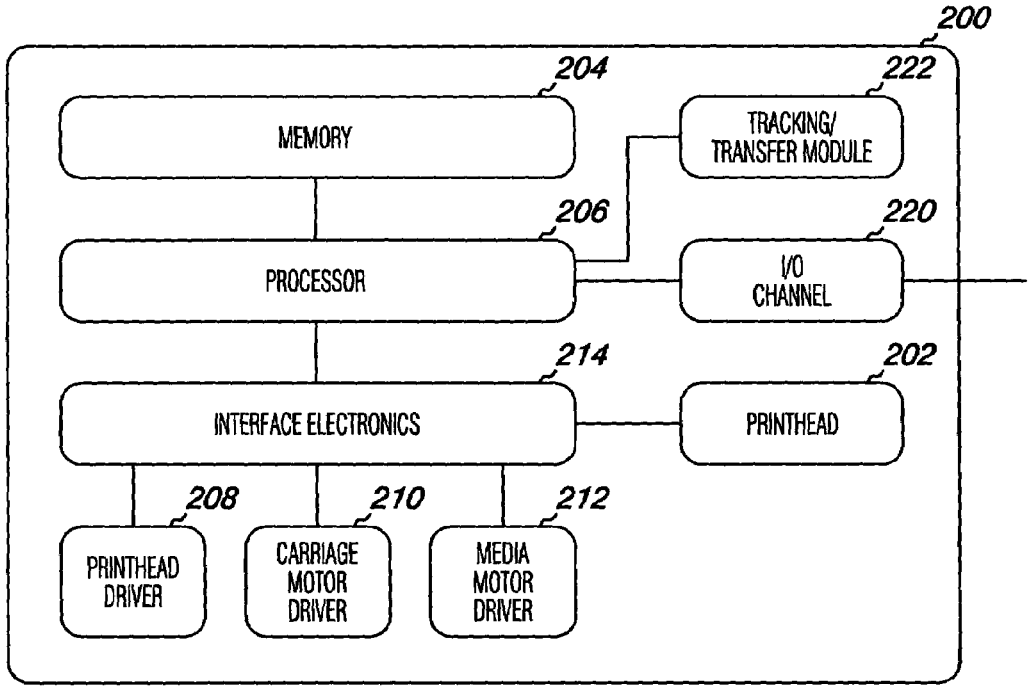
FIG. 2 illustrates a block diagram of an embodiment of electronic components for a image forming device.

FIG. 2 illustrates an embodiment of the electronic components associated with a printing device 200, such as printing device 100 in FIG. 1. As shown in FIG. 2, the electronic components of printing device 200 can include a media marking mechanism such as printhead 202. Electronic components of printing device 200 can also include control logic in the form of executable instructions which, for example, can exist within memory 204 and can be executed by a controller or processor, such as processor 206, to eject ink drops onto the print media. The executable instructions carry out various control steps and functions for the printing device 200. Memory 204 can include some combination of ROM, dynamic RAM, magnetic media, and optically read media, and/or some type of nonvolatile and writeable memory such as battery-backed memory or flash memory.

The processor 206 is operable on software, e.g., computer executable instructions, received from memory 204 or via an input/output (I/O) channel 220. The embodiments of the invention, however, are not limited to any particular type of memory and are not limited to where within a device or networked system a set of computer instructions reside for use in implementing the various embodiments of invention.

Figure 8:
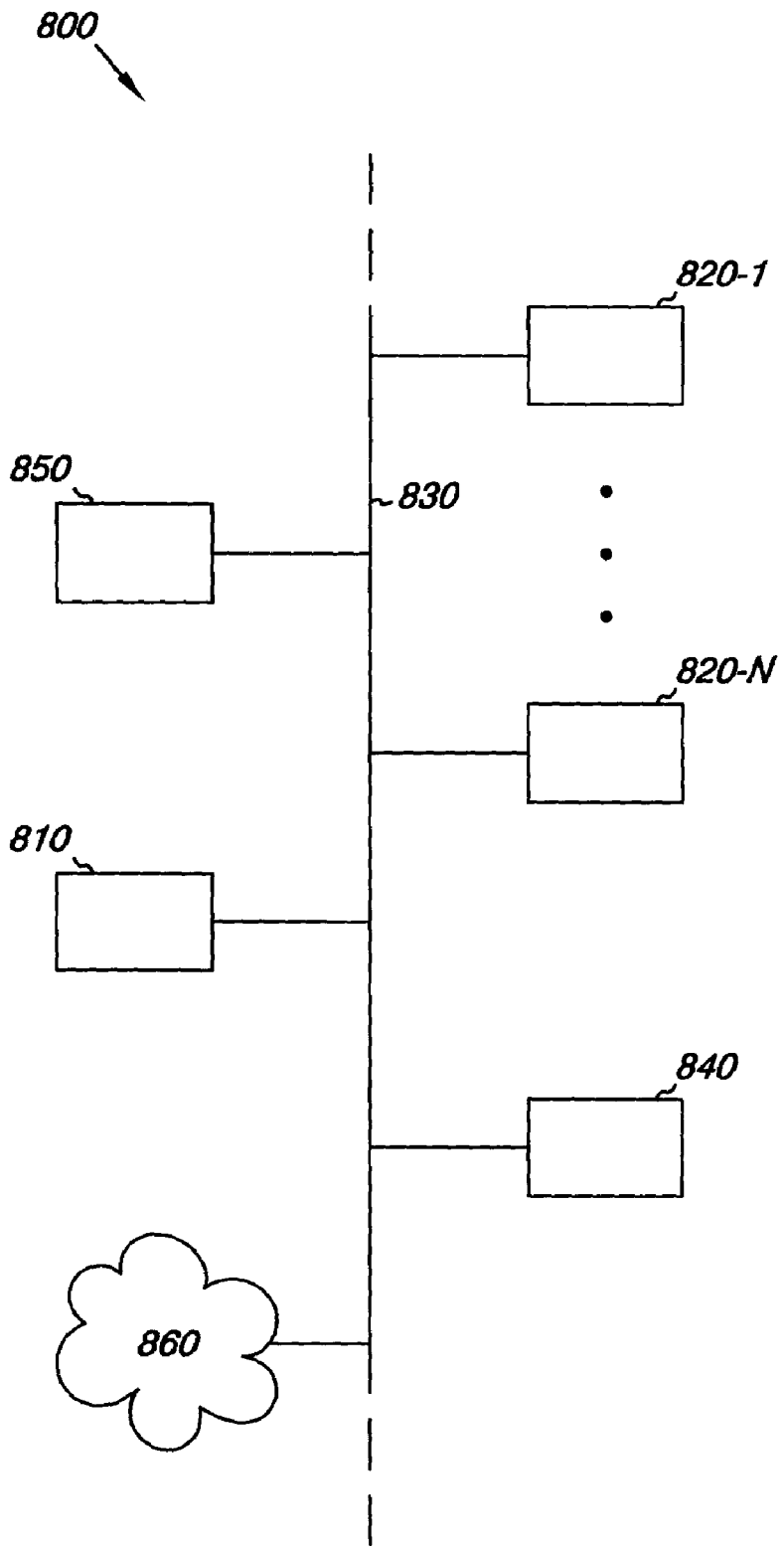
FIG. 8 illustrates a system embodiment.

The processor 206 can be interfaced, or connected, to receive instructions and data from a remote device (e.g. host computer), such as 820-1 shown in FIG. 8, through one or more I/O channels or ports 220. I/O channel 220 can include a parallel or serial communications port, and/or a wireless interface for receiving data and information, e.g. print job data, as well as other computer executable instructions, e.g., software routines.

FIG. 2 further illustrates an embodiment having a printhead driver 208, a carriage motor driver 210, and a media motor driver 212. Interface electronics 214 are associated with the printing device 200 to interface between the control logic components and the electromechanical components of the printer such as the printhead 202. Interface electronics 214 include, for example, circuits for moving the printhead and paper, and for firing individual nozzles. For example, the carriage motor driver 210 and the media motor driver 212 can be coupled to interface electronics 214 for moving the printhead 202 and print media. The printhead driver 208 can be coupled to interface electronics 214 to fire individual nozzles on the printhead 202.

The printhead driver 208, the carriage motor driver 210, and the media motor driver 212 can be independent components or combined on one or more application specific integrated circuits (ASICs). The embodiments of the invention are not so limited. The printhead driver 208, the carriage motor driver 210, and the media motor driver 212 can be utilized to execute computer executable instructions, or routines thereon.

The processor 206 can also be interfaced with an ink volume tracking and transfer module 222. The ink volume tracking and transfer module 222 can execute instructions according to software to track the ink volume in both the print cartridge reservoir and the supply tank. The ink volume tracking and transfer module 222 can also execute instructions according to software to transfer ink from the supply tank to the print cartridge reservoir (as shown in more detail in FIG. 3). The ink volume tracking and transfer module 222 can include hardware, software, firmware, or some combination thereof That is the ink volume tracking and transfer module 222 can include gates programmable by software and/or firmware. The tracking and transfer functions can be provided as independent modules or can be combined in a single module as shown. Embodiments of the invention are not so limited.

Figure 3:
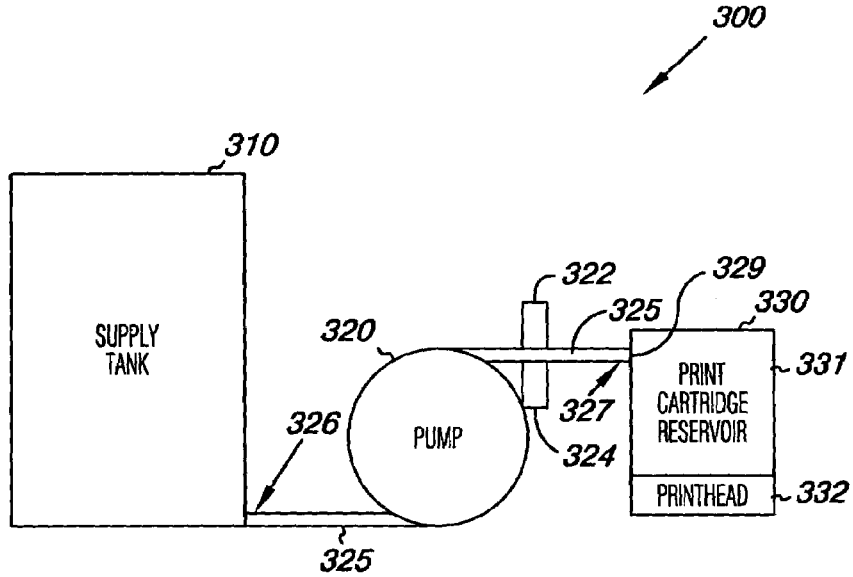
FIG. 3 illustrates an embodiment of a print cartridge reservoir refill apparatus.

FIG. 3 illustrates an embodiment of a print cartridge reservoir refill system, or ink transfer system 300. As shown in the embodiment of FIG. 3, a supply tank reservoir 310 is coupled to a print cartridge 330 through a flexible conduit 325. The print cartridge 330 includes a print cartridge reservoir 331 and a printhead 332. As mentioned in connection with FIG. 1, the supply tank can include a replaceable supply tank reservoir 310 located in the service bay area. By way of example and not by way of limitation, the pump 320 can be a peristaltic pump and can also be located in the service bay area of a printing device. The flexible conduit 325 can include a flexible tube having a first end 326 which can detachably connect to the supply tank 310 so that the supply tank can be replaced. The supply tank 310 could also seat into a release valve to fluidly connect the supply tank to the flexible conduit 325. Embodiments are not limited to these examples. The flexible conduit also has a second end 327 which can detachably connect to the print cartridge reservoir 331 on the print cartridge 330. This similarly allows for the print cartridge 330 to be replaced. The flexible conduit 325 allows the print cartridge to move with the carriage shown in FIG. 1.

The pump 320, such as a peristaltic pump, is capable of moving fluid (i.e. ink) back and forth between the print cartridge reservoir 331 and the supply tank 310. Embodiments which use a peristaltic pump provide an air tolerant ink transfer system 300. That is, a peristaltic pump can pump both air and fluid through the flexible conduit 325. The pump 320 can pump bi-directionally, e.g., in a forward and a reverse direction, and a pumping session can include moving ink back and forth between the print cartridge reservoir 331 and the supply tank reservoir 310.

As shown in the embodiment of FIG. 3, one or more sensors, e.g., 322 and 324, can be used to monitor the flow of ink, or other fluid, and air through the flexible conduit 325. By way of example and not by way of limitation, the one or more sensors 322 and 324 can include a pair of electrical probes. The software and/or firmware in association with the tracking and transfer module shown in FIG. 2 can be configured to measure a capacitance between the pair of electrical probes. Thus, when a first quantity or mixture of air and fluid such as ink is in the flexible conduit 325 a first capacitance, or absence thereof, can be detected to indicate a first state. Likewise, when a second quantity or mixture of air and fluid is in the flexible 325 conduit a second capacitance can be detected and associated with a second state. As another example, the one or more sensors 322 and 324 can include a light emitting source 322 and a light detector 324. Again, when a first quantity or mixture of air and fluid is in the flexible conduit 325 light emitted from the light emitting source 322 can be detected by the light detector 324 as a first intensity and when a second quantity or mixture of air and fluid is in the flexible conduit 325 light emitted from the light emitting source 322 can be detected by the light detector 324 as a second intensity.

As the shown in the embodiment of FIG. 3, an attachment level or point 329 for the second end of the flexible conduit 327 can be located near a top of the print cartridge reservoir 331. In this manner, as the ink is advanced forward into the print cartridge reservoir 331 it can dispense into the print cartridge reservoir 331 to refill the reservoir under the action of gravity. Embodiments, however, are not limited to the attachment point 329 shown in FIG. 3. During the course of a pumping session the pump 320, e.g., a peristaltic pump, will alternate between a forward pump cycle and a reverse pump cycle. Thus, during a reverse pump cycle the pump 320 will pump from the print cartridge reservoir 331 toward the supply tank 310. In this example, if the print cartridge reservoir 331 is not filled to the attachment level 329 air may be drawn into the flexible conduit 325 instead of, before or in addition to ink being drawn back into the flexible conduit on the reverse pump cycle.

In one embodiment, as a peristaltic pump 320 moves ink forward, e.g., in a forward pump cycle from the supply tank 310 to the print cartridge reservoir 331, the sensors 322 and 324 can be turned off. In the reverse pump cycle the sensors 322 and 324 can be turned on, e.g. to measure capacitance or light intensity as described above. The detection and measurement function of the sensors 322 and 324 together with the software and/or firmware associated with the tracking and transfer module can provide a state indication, e.g., a fluid fill level for the print cartridge reservoir 331. For example, the presence of a certain quantity of air or other gas detected in the flexible conduit 325 can indicate that the print cartridge reservoir 331 has not yet been filled to the attachment level 329 in which case the pumping session, forward and reverse cycles can continue. When a different state indication is detected on a reverse pump cycle, e.g., detection of mostly fluid in the flexible conduit 325, the pumping session can halt. Embodiments, however, are not limited to this particular example.

The above described cycles can be repeated, forward and reverse, numerous times in a given pumping session. Eventually enough ink will have been dispensed into the print cartridge reservoir 331 to fill the reservoir to the attachment level 329. The sensors 322 and 324 will detect this state and the ink transfer system 300 will recognize that the print cartridge reservoir 331 has been completely refilled.

The ink transfer system 300 can record and monitor how many pumping sessions have occurred since a new supply tank 310 was attached to the system 300. With each forward pump cycle, the system can know the volume of ink which is being transferred forward from the supply tank 310 into the print cartridge reservoir 331. That is, a pumping capacity, volume and rate, can be known or derived from the specifications for the particular pump employed. Using the software and/or firmware associated with the tracking and transfer module each pumping session can be monitored. In this manner, a depletion of the volume of ink in the supply tank 310 can be tracked. Similarly, a volume capacity of the print cartridge reservoir can be known from or derived from the specifications for a particular print cartridge 330. In this manner, the system can know the volume of ink in the print cartridge reservoir 331 when the reservoir is filled.

Additionally, the printhead 332 and the software operable in connection with processor 206 and/or print driver 208 for firing the printhead can calculate the volume of ink which is depleted from the print cartridge reservoir 331 as the printhead is fired to eject various quantities of ink onto print media according to the instructions of a print job. Accordingly, the software and/or firmware associated with the tracking and transfer module can use this information to determine a volume of ink which has been depleted from the print cartridge reservoir 331 since the print cartridge reservoir 331 was last filled. The software can function with the ink tracking and transfer module described in FIG. 2 to detect when the print cartridge reservoir 331 is empty or near empty. When such a state is detected the software is operable in connection with the ink tracking and transfer module described in FIG. 2 to initiate another pumping session. However, the software can also function with the ink tracking and transfer module described in FIG. 2 to detect when a volume of ink remaining in the supply tank 310 suffices to refill the print cartridge reservoir 331 to the attachment level 329, e.g., a predetermined level. When such a state is detected the software is operable in connection with the ink tracking and transfer module described in FIG. 2 to initiate another pumping session. In this manner, the ink tracking and transfer module will activate pumping sessions with a variable frequency such that refilling of the print cartridge reservoir 331 occurs both when the print cartridge reservoir 331 is empty or the volume of ink remaining in the supply tank 310 is equal to a volume of ink which will suffice to refill, e.g., top off, the print cartridge reservoir 331 to a predetermined level. Thus, the supply tank reservoir 310 can be fully depleted and exchanged or replaced while leaving a print cartridge reservoir 331 refilled to the predetermined level to continue printing.

It is further noted that the peristaltic action of a peristaltic pump 320, forward and reverse, can aid to improve the mixing of inks in the print cartridge reservoir 331 and between the supply tank reservoir 310 and the print cartridge reservoir both during use between supply tank replacement and as new supply tank reservoirs are added. This can improve the consistency of ink delivered by the printhead 332 to the print media.

Embodiments of this ink transfer system 300 operate according to software instructions to control ink transfer based on tracked and/or measured ink volumes, ink transfer rates and/or ink consumption. Ink volumes can be tracked and/or measured in the system 300 using software coupled to ink sensors including, but not limited to, fluid level float sensors, fluid flow sensors, electrical sensors and/or optical sensors. Embodiments for variable frequency reservoir refilling are not limited to these sensor examples.

Figure 4:
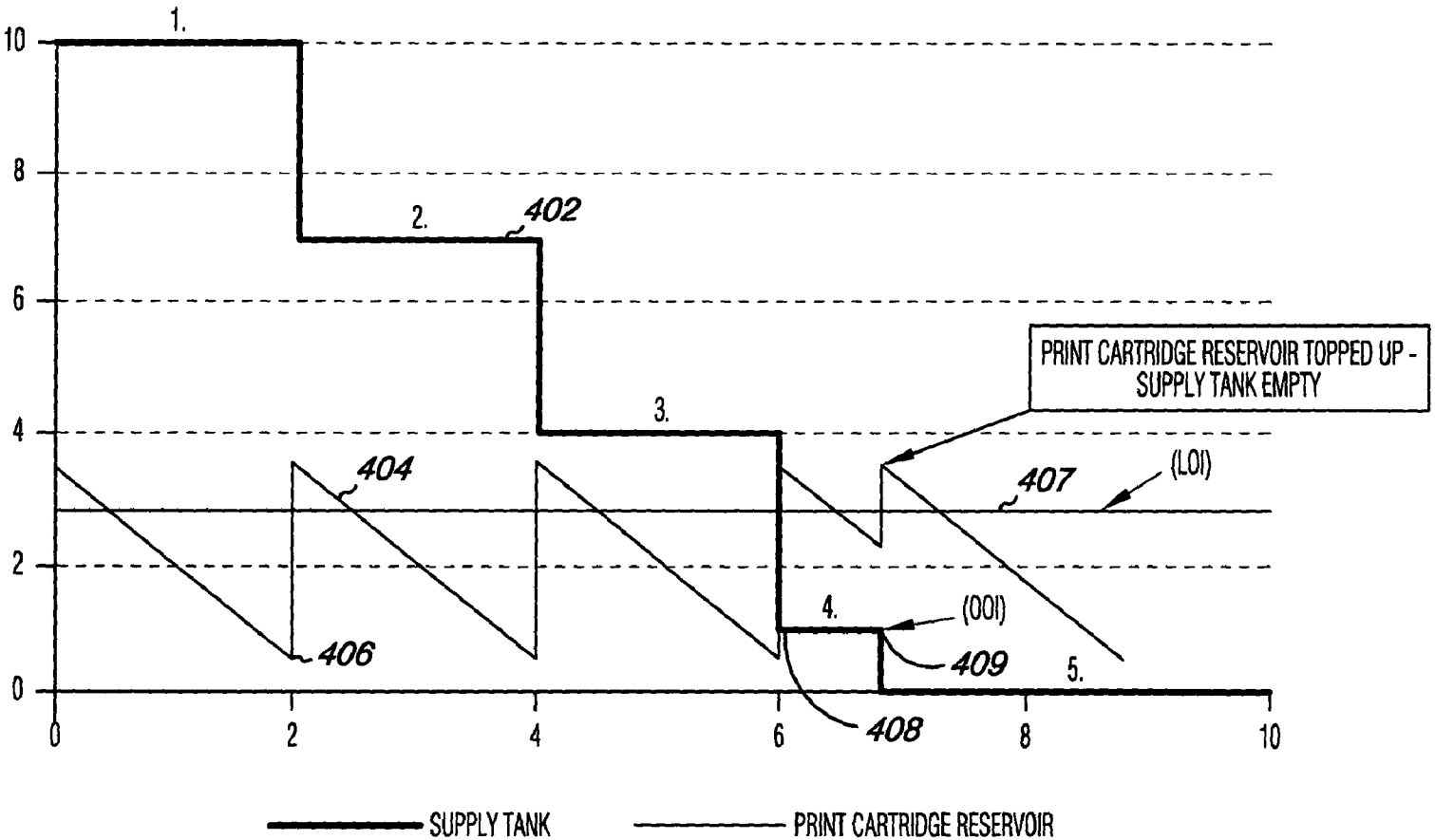
FIG. 4 is a graph illustrating an embodiment for variable print cartridge reservoir refill.

FIG. 4 is a graph illustrating an embodiment for a variable print cartridge reservoir refill system. The example of FIG. 4 depicts refilling the print cartridge reservoir both when the print cartridge reservoir is substantially empty or the volume of ink remaining in the supply tank is equal to a volume of ink which will suffice to refill the print cartridge reservoir to a predetermined level. This may include completely refilling, e.g., toping off, the print cartridge reservoir, refilling the print cartridge to an initial fill level substantially equal to the level of ink in the print cartridge before its first use, or refilling the print cartridge to less than a complete refill. The ink volume in the supply tank is illustrated in FIG. 4 as the heavy-weight, descending step line 402. The print cartridge reservoir ink volume is illustrated as the light-weight, saw-tooth line 404.

In the graph of FIG. 4, volume is expressed along the y-axis and periods of use between refill pump cycles are expressed along the x-axis. The periods between refill pump cycles illustrate a depletion of the ink volume in the supply tank, line 402, relative to the ink volume in the print cartridge reservoir, line 404. The saw-tooth line 404 for the print cartridge reservoir ink volume illustrates an example as if the print cartridge were firing a constant volume over a continuous period. Embodiments of the invention, however, are not limited to this scenario of a depletion rate.

Arbitrary units have been selected for the x and y axes to illustrate the operation of the variable print cartridge reservoir refill system. What is noted is that a volume of ink in the print cartridge reservoir is gradually depleted through printhead use between refill cycles, e.g., pumping sessions. Beginning at 0 on the x-axis, the supply tank is illustrated as being full, e.g., y=10 on the y-axis. The print cartridge reservoir is also illustrated as being full, e.g., y=3.5 on the y-axis. The supply tank can hold a volume of ink which is greater than that held in the print cartridge reservoir. During a period of printhead use, e.g. starting with a first period (1.), the graph of FIG. 4 illustrates a print cartridge reservoir beginning with a full volume of ink and gradually depleting through use of printhead ejecting drops of ink onto print media. During this period (1.) the volume of ink in the supply tank remains relatively constant, shown as a level volume of y=10. Barring other environmental effects, the ink volume in the supply tank is shown as constant to reflect that no pumping of ink from the supply tank to the print cartridge reservoir is occurring during this period. However, when the system detects at 406 that either a certain volume of ink has been depleted from the print cartridge reservoir, or alternatively that the print cartridge reservoir is empty, the system will begin a pumping session to transfer ink from the supply tank to the print cartridge reservoir.

As illustrated at point 406 a volume of ink is transferred from the supply tank to the print cartridge reservoir. This is reflected on the graph by the volume in the supply tank decreasing in a step fashion to a lesser volume level. The difference between the beginning volume level, e.g., y=10, and the new volume level, e.g., y=7, equates to the volume transferred to the print cartridge reservoir. In other words, the supply tank volume is illustrated as having decreased to a volume of y=7, a change in 3 units of ink, while the print cartridge reservoir volume is illustrated as having been replenished from a volume of y=0.5 to y=3.5 units.

As shown in FIG. 4, this scenario of print cartridge reservoir depletion and ink transfer from the supply tank to the print cartridge can repeat over a number of periods depending on the capacity of the supply tank. Thus in the embodiment of FIG. 4, a pumping session refills the print cartridge reservoir at the end of a second period (2.) and a third period (3.) according to a similar trigger event, e.g., that either a certain volume of ink has been depleted from the print cartridge reservoir, or alternatively that the print cartridge reservoir is empty. A user will typically experience a uniform amount of ink consumption or average number of printable pages between refill pump cycles, e.g., pumping sessions, for similar print job usage.

According to embodiments a threshold, can be selectably chosen by software or firmware in connection with an ink tracking and transfer module, described in connection with FIG. 2, to indicate when the ink volume in the supply tank is becoming low. By way of example and not by way of limitation, a threshold can be set at a volume which would suffice to completely refill an empty printhead cartridge reservoir or refill a printhead cartridge reservoir to a predetermined level. In the embodiment of FIG. 4, this selectably chosen threshold is illustrated by line 407 at a level of approximately 3 unit volumes of ink remaining in the supply tank. Thus, when the ink tracking and transfer module detects that the ink volume remaining in the supply tank has passed below this threshold the system may provide a notification on the printing device, such as on the display 110 of FIG. 1, indicating that the supply tank is low on ink (LOI). Such a notification can serve as a notice that a user of the printing device should have a replacement supply tank available.

As shown in the embodiment of FIG. 4, a refill pump cycle, or pumping session, is again triggered at point 408 (e.g., in this example the start of period 4) having been triggered by a detection by the ink tracking and transfer module that either a certain volume of ink has been depleted from the print cartridge reservoir, or alternatively that the print cartridge reservoir is empty. As shown in FIG. 4, however, it is now noted that the volume of ink remaining in the supply tank at the completion of the pumping session is only approximately 1.0 unit volume of ink. As described above, software or firmware in connection with an ink tracking and transfer module can register this state.

As the print cartridge continues to perform print jobs ejecting drops of ink from the printhead onto print media, the software or firmware in connection with an ink tracking and transfer module can track the ink volume depletion in the print cartridge reservoir since the print cartridge reservoir was last refilled at the start of period 4. When the software or firmware in connection with an ink tracking and transfer module detects that approximately 1.0 unit volume of ink has been depleted from the print cartridge reservoir since the print cartridge reservoir was last refilled it will trigger a refill pump cycle as shown at point 409. In this manner the ink transfer system will refill the print cartridge reservoir with the remaining ink volume in the supply tank such that at a point in time when the supply tank is substantially fully depleted the print cartridge reservoir is refilled to a predetermined level or fully refilled. At this point in time the system may provide a notification on the printing device, such as on the display 110 of FIG. 1, indicating that the supply tank is empty, or out of ink (OOI).

At point 409 (e.g., in this example at the start of period 5) the print cartridge will be begin to deplete the volume ink in the print cartridge. The volume of ink in the supply tank has been depleted since the last refill pump cycle. However, as illustrated in the embodiment of FIG. 4, by initiating a refill pump cycle when the volume of ink remaining in the supply tank is equal to a volume of ink which will suffice to refill the printhead cartridge reservoir to a predetermined level or completely refill, e.g., top off, the printhead cartridge reservoir, the print cartridge reservoir can be refilled at a point in time when a user of the printing device is notified that the supply tank is out of ink. A user of the device of the printing device will now have the same amount of ink available for use or realize the same average number of printable pages in similar print job usage, before the print cartridge reservoir is depleted, as the user had previously experienced between pumping sessions. Hence, embodiments of the invention can avoid leaving print cartridge reservoirs refilled to less than the predetermined level going forward from the point in time when the user is provided with an out of ink notice on a printing device.

Figure 5:
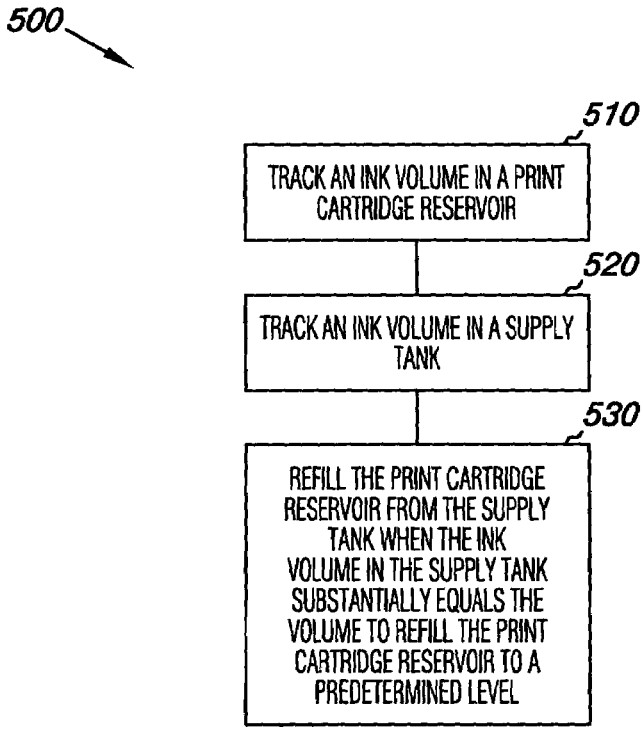
FIG. 5 illustrates a method embodiment.
Figure 6:
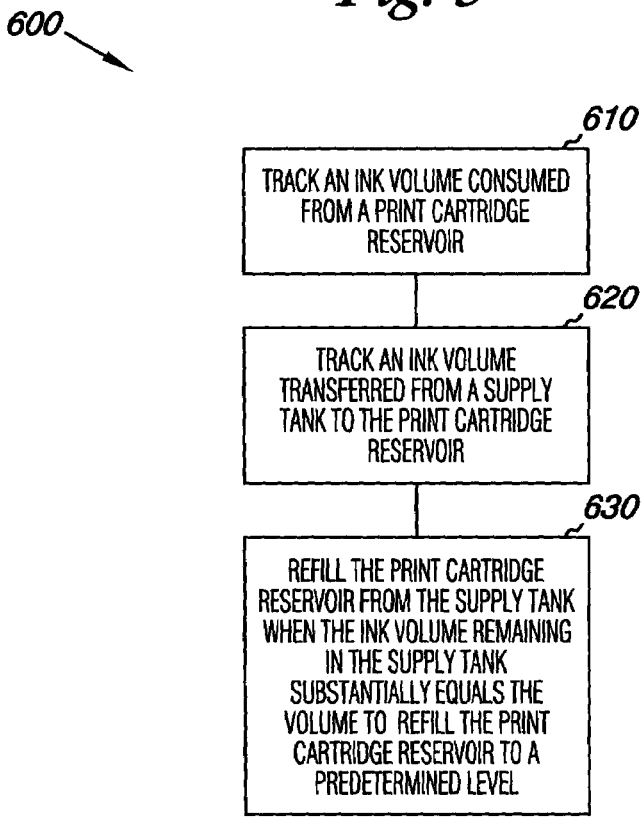
FIG. 6 illustrates another method embodiment.
Figure 7:
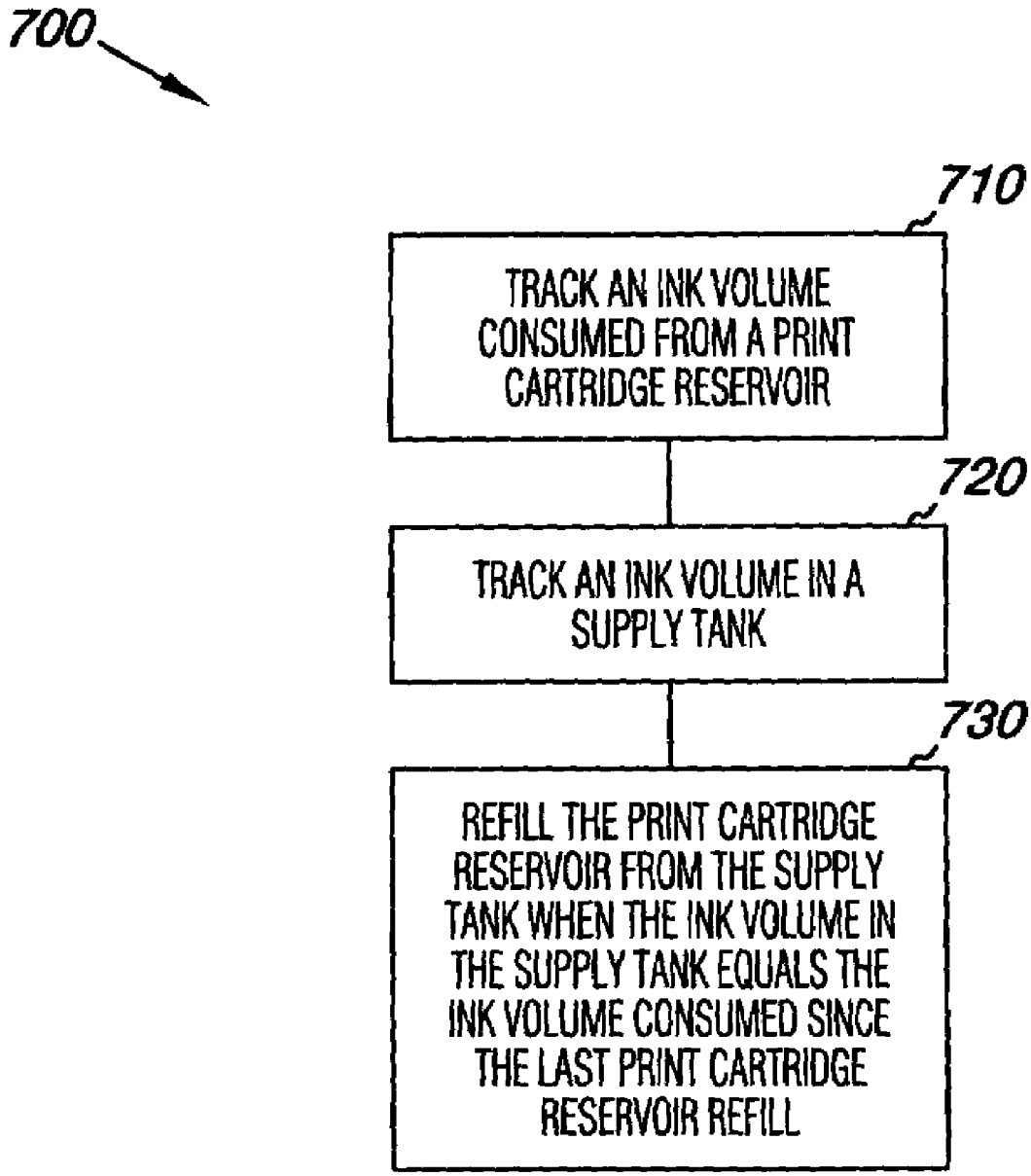
FIG. 7 illustrates another method embodiment.

FIGS. 5-7 illustrate various method embodiments which provide for variable frequency print cartridge reservoir refilling. The methods described herein can be performed by software (e.g. computer executable instructions) operable on the systems and devices shown herein or otherwise. The embodiments of the invention, however, are not limited to any particular operating environment or to software written in a particular programming language. Unless explicitly stated, the method embodiments described herein are not constrained to a particular order or sequence. Additionally, some of the described method embodiments or elements thereof can occur or be performed at the same point in time.

FIG. 5 illustrates a method embodiment for refilling the print cartridge reservoir from a supply tank. The method includes tracking an ink volume in the print cartridge reservoir, as shown at block 510. The ink volume within the print cartridge reservoir may be tracked using software and sensors as the same have been described herein.

Software may track the ink volume in the print cartridge reservoir by comparing the ink volume consumed during print job processing and the ink volume transferred to the print cartridge reservoir from a supply tank. The ink volume consumed can be tracked using software and measurements of ink drops fired during print job processing. The ink volume consumed from the print cartridge reservoir during the processed print job could then be calculated based on the mass and density of the ink drops.

The method also includes tracking an ink volume in a supply tank as shown in block 520. The ink volume within the supply tank may be tracked using sensors as the same have been described herein. The ink volume in the supply tank can be tracked according to the ink volume transferred to the print head reservoir.

The method includes refilling the print cartridge reservoir from the supply tank when the ink volume in the supply tank substantially equals the volume to refill the to refill the print cartridge reservoir to a predetermined level, as shown in block 530. As used herein, substantial equality refers to having approximately equal volumes within a range of possible measurement error associated with the various volume measurement techniques described herein as used to measure the supply tank volume and/or print cartridge reservoir volume. Print cartridge reservoir refilling based on tracked printhead reservoir and supply tank ink volumes will result in a print cartridge reservoir refilled to substantially the predetermined level when the supply tank is depleted.

FIG. 6 illustrates another method embodiment for refilling the print cartridge reservoir from a supply tank. In various embodiments of the invention, the print cartridge is a removable cartridge located on a moveable print carriage. Additionally, one or more supply tanks are located within the printing device. Also, the supply tanks are located off-axis (e.g. in a service bay) from the print carriage.

In various embodiments, a supply tank is capable of containing enough ink to provide multiple print cartridge reservoir refills. In addition, one supply tank may be used to refill one or more print cartridge reservoirs. Also, one print cartridge reservoir may be refilled by one or more supply tanks.

In the embodiment shown in FIG. 6, the method includes tracking the volume of ink consumed from the print cartridge reservoir during print job processing as shown in block 610. As previously stated, the volume of ink consumed from the print cartridge reservoir can be tracked using software and ink sensors including fluid level, optical and/or electrical sensors. Alternatively, the volume of ink consumed can be tracked using software and by measuring ink drops produced as a function of a processed print job. However, the embodiments of the present invention are not so limited.

In the embodiment shown in FIG. 6, the method also includes tracking the volume of ink transferred from the supply tank to the print cartridge reservoir as shown in block 620. The method includes tracking transferred ink volumes when an initial transfer is made from a full supply tank. The ink volume transferred is incremented and the ink volume remaining in the supply tank is calculated. When depleted, the supply tank can be refilled and the tracked transferred volume is reset to reflect full supply tank conditions.

In various embodiments of the present invention, the ink volume may be tracked using software and sensors associated with a transfer conduit as the same have been described herein. Ink volume may be tracked by measuring ink volume changes in the print cartridge reservoir. These volume changes would include increases in volume during ink transfer and decreases in volume related to ink consumption during print job processing.

The method embodiment illustrated in FIG. 6 further includes refilling the print cartridge reservoir from the supply tank according to tracked ink consumption and transfer. In various embodiments, refilling occurs when a total ink volume remaining in the supply tank is substantially equal to a volume which would refill the print cartridge reservoir to a predetermined level, as shown in block 630. The method additionally includes refilling the print cartridge reservoir when the print cartridge reservoir is empty or near empty.

FIG. 7 illustrates another method embodiment for periodically refilling the print cartridge reservoir from a supply tank. The embodiment of FIG. 7 includes tracking the volume of ink consumed from the print cartridge reservoir during print job processing as shown in block 710 as described herein. The embodiment of FIG. 7 includes tracking the ink volume in the supply tank as shown in block 720. The ink volume in the supply tank may be tracked using software and ink sensors. These sensors can include fluid level, electrical and/or optical sensors.

The method further includes refilling the print cartridge reservoir from the supply tank according to a periodic ink consumption frequency. However, the method further includes refilling the print cartridge reservoir when the ink volume remaining in the supply tank equals the ink volume consumed during print job processing since the last refill pump cycle as shown in block 730. FIG. 8 illustrates an embodiment of a printing device 810 networked in a system environment 800. The printing device 810 can include a printing device with a variable frequency print cartridge reservoir refilling capability according to the embodiments that have been described herein. In the embodiment of FIG. 8, the system printing device 810 is illustrated networked to a number of remote devices, 820-1 to 820-N, via a number of data links 830. As illustrated in FIG. 8, the printing device can further be connected to other peripheral devices 840, e.g., other scanning device or fax capable devices, to a storage device 850, and to Internet access 860. The remote devices, 820-1 to 820-N, can include a desktop computer, laptop computer, a workstation, a server, a hand held device, e.g., a wireless phone, a personal digital assistant (PDA), or other devices as the same will be known and understood by one of ordinary skill in the art.

The number of data links 830 can include one or more physical connections, one or more wireless connections, and/or any combination thereof. The networked system environment shown in FIG. 8 can include any number of network types including, but not limited to, a Local Area Network (LAN), a Wide Area Network (WAN), a Personal Area Network (PAN), and a Wireless-Fidelity (Wi-Fi) network, among others.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the invention.

It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the invention includes any other applications in which the above structures and methods are used. Therefore, the scope of various embodiments of the invention should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the invention use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for refilling a print cartridge reservoir, comprising:

tracking an ink volume consumed from the print cartridge reservoir;

tracking an ink volume transferred from a supply tank to the print cartridge reservoir;

refilling the print cartridge reservoir using a variable refill frequency based on the ink volume consumed from the print cartridge reservoir and the ink volume transferred from the supply tank; and wherein refilling occurs resulting from when a total ink volume remaining in the supply tank is equal to a volume which would refill the print cartridge reservoir to an initial fill level.

2. The method of claim 1, wherein refilling also occurs when the print cartridge reservoir is empty.

3. The method of claim 1, wherein the print cartridge reservoir is located on a moveable print carriage.

4. The method of claim 3, wherein the supply tank is located off-axis from the moveable print carriage.

5. The method of claim 1, wherein one supply tank is used to refill multiple print cartridge reservoirs.

6. The method of claim 1, wherein one print cartridge reservoir is refilled from multiple supply tanks.

7. A computer readable medium having a set of computer executable instructions thereon for causing a device to perform a method, comprising:

tracking an ink volume in a print cartridge reservoir;

tracking an ink volume in a supply tank;

refilling the print cartridge reservoir on a variable frequency based on both tracked print cartridge reservoir and supply tank ink volumes; and wherein refilling occurs resulting from when an ink volume consumed from the print cartridge reservoir since its last refill substantially equals a total ink volume remaining in the supply tank.

8. The medium of claim 7, further including tracking print cartridge reservoir and supply tank ink volumes based on processed print jobs and ink volumes transferred from the supply tank to the print cartridge reservoir.

9. The medium of claim 7, further including executable instructions to control the transfer of ink from the supply tank to the print cartridge reservoir.

10. The medium of claim 7, wherein the executable instructions control a pumping session of a peristaltic pump.

* * * * *